US006994585B2

(12) United States Patent
Benoit et al.

(10) Patent No.: US 6,994,585 B2
(45) Date of Patent: Feb. 7, 2006

(54) ELECTRICAL WIRING SYSTEM

(75) Inventors: John Benoit, Montpelier, VT (US); Gerald R. Savicki, Jr., Syracuse, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

(21) Appl. No.: 10/680,797

(22) Filed: Oct. 7, 2003

(65) Prior Publication Data

US 2005/0075007 A1 Apr. 7, 2005

(51) Int. Cl.
*H01R 13/60* (2006.01)

(52) U.S. Cl. ..... 439/535; 439/536; 174/58

(58) Field of Classification Search ..... 439/536, 439/535, 650; 174/48, 66, 67, 50, 53, 58, 174/68; 220/241
See application file for complete search history.

(56) References Cited

U.S. PATENT DOCUMENTS

| | | | | | |
|---|---|---|---|---|---|
| 3,641,472 | A | * | 2/1972 | Phillips, Jr. | 439/34 |
| 3,975,074 | A | * | 8/1976 | Fuller | 439/277 |
| 4,842,551 | A | * | 6/1989 | Heimann | 439/502 |
| 5,015,203 | A | * | 5/1991 | Furrow | 439/535 |
| 5,178,555 | A | * | 1/1993 | Kilpatrick et al. | 439/215 |
| 5,297,973 | A | | 3/1994 | Gorman | |
| 5,582,522 | A | * | 12/1996 | Johnson | 439/214 |
| 5,964,618 | A | * | 10/1999 | McCarthy | 439/574 |
| 6,028,268 | A | | 2/2000 | Stark et al. | |
| 6,045,374 | A | * | 4/2000 | Candeloro | 439/105 |
| 6,156,971 | A | | 12/2000 | May | |
| 6,309,248 | B1 | | 10/2001 | King | |
| 6,376,770 | B1 | * | 4/2002 | Hyde | 174/58 |
| 6,494,728 | B1 | | 12/2002 | Gorman | |
| 6,563,049 | B2 | | 5/2003 | May | |
| 6,774,307 | B2 | | 8/2004 | Kruse et al. | |
| 2002/0052139 | A1 | | 5/2002 | Gorman | |
| 2002/0055301 | A1 | | 5/2002 | Gorman | |
| 2005/0006124 | A1 | | 1/2005 | Kruse et al. | |

* cited by examiner

*Primary Examiner*—Tho D. Ta
(74) *Attorney, Agent, or Firm*—Bond, Schoeneck & King PLLC; Daniel P. Malley

(57) ABSTRACT

The present invention is directed to an electrical wiring system. The system includes a plug connector device that is configured to terminate a plurality of wires. A portion of the plurality of wires are configured to transmit electrical power provided by an electrical power distribution system. An electrical wiring device is configured to provide the electrical power to a load. The electrical wiring device includes a receptacle disposed therein. The receptacle is configured to receive the plug device, such that electrical continuity is established between the electrical wiring device and the plurality of wires when the plug device is inserted into the receptacle.

51 Claims, 10 Drawing Sheets

20

ELECTRICAL WIRING SYSTEM

BACKGROUND OF THE INVENTION

1. Field of the Invention

The present invention relates generally to electrical circuit installation, and particularly to electrical devices that facilitate installation of electrical circuits in a building or some other structure.

2. Technical Background

Installing electrical circuits in buildings and/or other structures is typically labor intensive, time-consuming, and a process that requires electricians of various skill levels. As a result the installation process is expensive. The first phase of the installation is commonly referred to as the "rough-in" phase. In new construction, either conduit or armored cable is disposed through out the structure in accordance with the building plans. Junction boxes are installed at appropriate locations, and brackets and metal device boxes are installed throughout the structure where electrical service is desired. Junction boxes, of course, are employed to house the connection point, or junction, of several conductors. Metal device boxes are used to accommodate electrical wiring devices. For example, the types of electrical wiring devices may include, but are not limited to, receptacles, switches, dimmers, GFCIs, transient voltage surge suppressors (TVSS), timer devices, sensors of various types, thermostats, lighting fixtures, and/or combinations thereof. After the boxes are placed, the electrical wires are pulled through the conduits and all of the circuits are bonded. At this point, the leads from the electrical wires extend from the boxes and are visible and accessible for the next phase of the installation process.

Before discussing the next phase of the process, it is noted that electrical cables may include two to five conductive wires. For example, in a structure that requires high power, the most common way of distributing that power is by employing the three-phase power system. As those of ordinary skill in the art recognize, five wires are employed. Three phase power includes three "hot" or "live" wires. Each of these wires transmits electrical power that is 120 degrees out of phase with the other two hot wires. The other two wires are the neutral conductor and the ground wire. Three phase power typically comes from the power utility via four wires: the three-phase wires, and the neutral. If the current flowing through each of the phases is equal, no current will flow through the neutral. The neutral wire is typically connected to the building ground at the structure's main distribution panel. The five wire cable is distributed from the central panel. Some of the circuits in the structure are designed to provide power to grounded equipment. These circuits may employ three wires, a line conductor (hot wire), a neutral conductor, and a ground. Some circuits may only employ two wires, the line conductor and the neutral conductor.

Referring back to the installation process, after the "rough-in" phase has been completed, the electrical wiring devices are terminated, i.e., they are electrically connected to the wire leads. This part of the installation process is the most costly and time consuming. A journeyman electrician must perform, or supervise, the connection of each wiring device in the structure. In this process, each electrical wire must be stripped and terminated to the device. What is needed is an efficient, labor-saving, and cost effective means for terminating the electrical wires and coupling them to the individual devices.

SUMMARY OF THE INVENTION

The present invention addresses the problems described above. The present invention is directed to an electrical wiring system that simplifies the installation process. Further, the present invention provides an efficient system and method for terminating electrical devices. The system and method is cost-effective because it eliminates many of the labor intensive practices that are currently in use.

One aspect of the present invention relates to an electrical wiring system that includes a plug connector device that is configured to terminate a plurality of wires. A portion of the plurality of wires are configured to transmit electrical power provided by an electrical power distribution system. An electrical wiring device is configured to provide the electrical power to a load. The electrical wiring device includes a receptacle disposed therein. The receptacle is configured to receive the plug device, such that electrical continuity is established between the electrical wiring device and the plurality of wires when the plug device is inserted into the receptacle.

In another aspect, the present invention includes a method for installing electrical wiring. The method includes installing a plurality of wires from a first location to an electrical device location. At least a portion of the plurality of wires are configured to transmit electrical power. The plurality of wires are then terminated using a plug connector. An electrical wiring device is configured to provide electrical power to a load. The electrical wiring device includes a receptacle disposed therein. The receptacle is configured to receive the plug device. The plug connector is inserted into the receptacle, such that electrical continuity is established between the electrical wiring device and the plurality of wires.

In yet another aspect, the present invention includes a plug connector configured to terminate a plurality of wires. The plurality of wires are configured to transmit electrical power provided by an electrical power distribution system. The connector includes a housing, and a plurality of self-locking contacts disposed in the housing. Each of the plurality of self-locking contacts are configured to terminate one of the plurality of wires, such that electrical continuity is established between the plurality of wires and the plurality of self-locking contacts.

In yet another aspect, the present invention includes a plug connector configured to terminate a plurality of wires. The plurality of wires are configured to transmit electrical power provided by an electrical power distribution system. The connector includes a housing, and a plurality of contacts disposed with the housing. A plurality of twist-on wire connector devices are coupled to corresponding ones of the plurality of contacts. Each of the at least one twist-on wire connector devices are configured to terminate one wire, such that electrical continuity is established between each wire and each contact.

In yet another aspect, the present invention includes a plug connector configured to terminate a plurality of wires. The plurality of wires are configured to transmit electrical power provided by an electrical power distribution system. The connector includes a first housing portion and a second housing portion configured to mate with the first housing portion. The first and second housing portions form the plug device housing. The plug connector also includes a plurality of contacts that include blade elements. The plurality of contacts may be disposed in either the first plug connector housing or the second plug connector housing or both. The blade elements are configured to displace insulation disposed on the plurality of wires when the second plug connector housing is coupled to the first plug connector housing, such that electrical continuity is established between each wire and a corresponding one of the plurality of contacts.

In yet another aspect, the present invention includes an electrical wiring device. The device includes a housing and at least one power output element disposed within the housing. The at least one power output element is configured to provide electrical power to a load. An input receptacle is also disposed within the housing. The input receptacle includes a plurality of electrical receptacle contacts. Electrical continuity is provided between the plurality of electrical receptacle contacts and the power output element such that electrical power may be transmitted from the plurality of electrical receptacle contacts to the power output element.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1A:
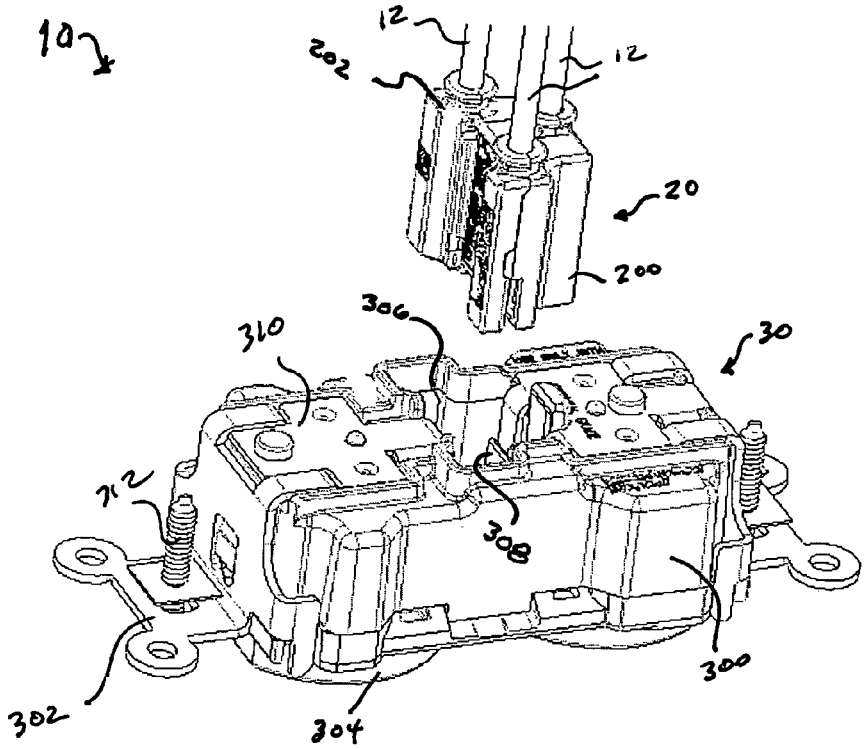
FIGS. 1A and 1B are perspective views of the electrical wiring system in accordance with the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the electrical wiring system of the present invention is shown in FIG. 1, and is designated generally throughout by reference numeral 10.

In accordance with the invention, the present invention is directed to an electrical wiring system. The system includes a plug connector device that is configured to terminate a plurality of wires. A portion of the plurality of wires are configured to transmit electrical power provided by an electrical power distribution system. An electrical wiring device is configured to provide the electrical power to a load. The electrical wiring device includes a receptacle disposed therein. The receptacle is configured to receive the plug device, such that electrical continuity is established between the electrical wiring device and the plurality of wires when the plug device is inserted into the receptacle. In light of the above, the present invention is directed to an electrical wiring system that simplifies the installation process by providing an efficient system and method for terminating electrical devices. Also, the system and method is cost-effective because it eliminates many of the labor intensive practices that are currently in use.

Figure 1B:
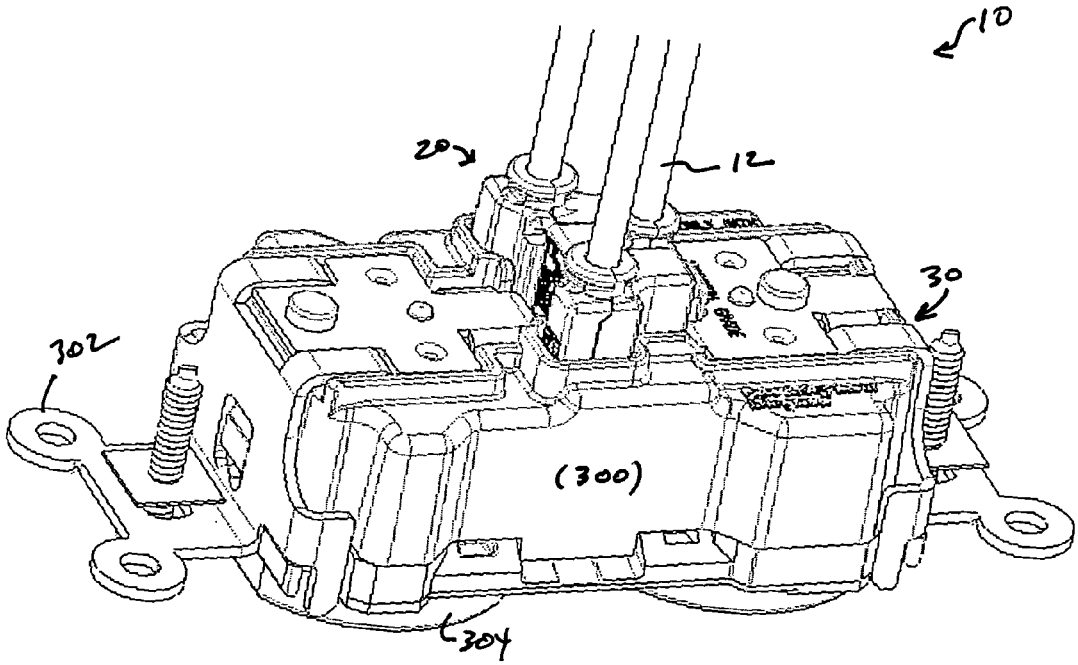

As embodied herein, and depicted in FIGS. 1A and 1B, perspective views of the electrical wiring system 10 in accordance with the present invention are disclosed. Referring to FIG. 1A, electrical wiring system 10 includes plug connector 20 which mates with electrical wiring device 30. Electrical power conductor wires 12 are terminated at plug 20. Plug 20 includes a housing 200 and contacts 202, which are disposed within body 200. In the embodiment shown, connector contacts 202 are female contacts designed to accept male contacts disposed within wiring device 30. In one embodiment, housing 200 is formed from injection molded plastic, polycarbonate, or other polymer based materials. Connector contacts 202 are typically fabricated using a copper alloy material. Those of ordinary skill in the art will recognize that any suitable material may employed in fabricating plug connector 20.

Electrical wiring device 30 includes a body 300, strap element 302, cover 304, power input receptacle 306, receptacle contacts 308, ground chassis 310, and mounting screws 312. In this embodiment, receptacle contact 308 is a male contact that is configured to mate with plug contact 202. Body 300 and cover 304 are injection molded components, again, using materials such as polymers, polycarbonate, or nylon materials. Contacts 308 are fabricated using copper alloy materials. Strap 302 may be fabricated using a copper alloy or by using plated steel. Ground chassis 310 is fabricated using a copper alloy. Because the embodiment shown is a 3-wie system that includes ground, ground chassis 310 includes a male contact tab that mates with one of the female contacts in plug 20.

In the example depicted in FIG. 1A and FIG. 1B, three wires are shown being terminated by plug 20. However, those of ordinary skill in the art will recognize that the present invention should not be construed as being limited to the embodiment shown. The present invention may be configured to accommodate 2 wire systems and three-phase (5 wires) systems, as well as the 3-wire system shown. Further, system 10 of the present invention may be adapted to a wiring system that employs more than 5 wires. While wires are shown being terminated by a single plug 20, those of ordinary skill in the art will recognize that the present invention may be configured to terminate the wires separately or in combination, within a plurality of plugs.

Figure 2:
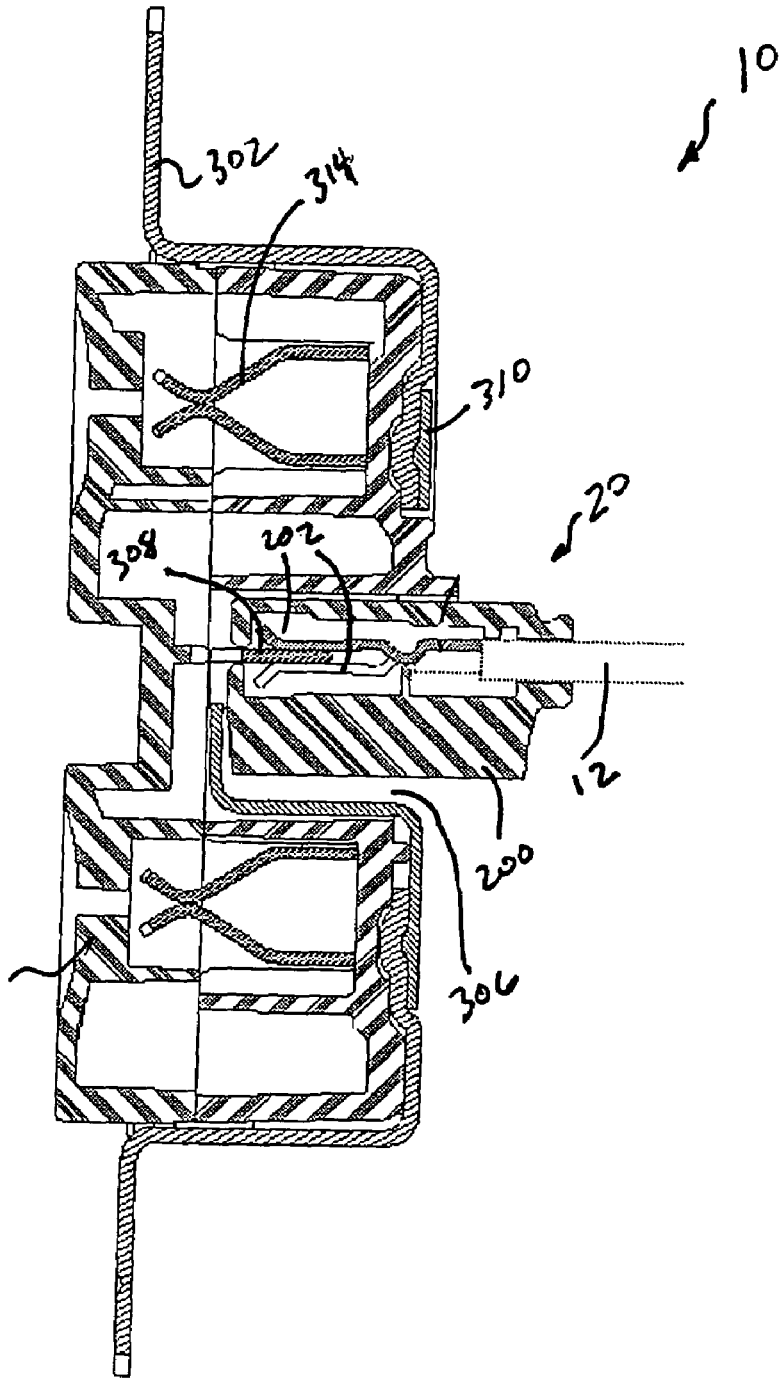
FIG. 2 is a cross-sectional view of the electrical wiring system depicted in FIG. 1B.

Referring to FIG. 2, a cross-sectional view of the electrical wiring system depicted in FIG. 1B is disclosed. Plug connector housing 200 fits within input receptacle 306. As such, male contact 308 is shown as being inserted between female contacts 202. FIG. 2 also shows power output receptacle 314, which is configured to receive the blade contacts from a plug. When plug 20 is installed in device 30, electrical continuity is established between the plurality of wires 12 and the wiring device. Thus, when wires 12 are energized, power is supplied to output receptacles 314. Those of ordinary skill in the art will recognize that while the example of FIGS. 1A and 1B shown a wiring device that provides output receptacles 314, the present invention may be practiced with any suitable type of wiring device. For example, wiring device 30 may include a switch, a dimmer switch, a GFCI, a transient voltage surge suppressor (TVSS), a timer mechanism, an occupancy sensor or other type of sensor, a thermostat, a night light, a lighting fixture, or a device that includes a combination of the above.

Figure 3:
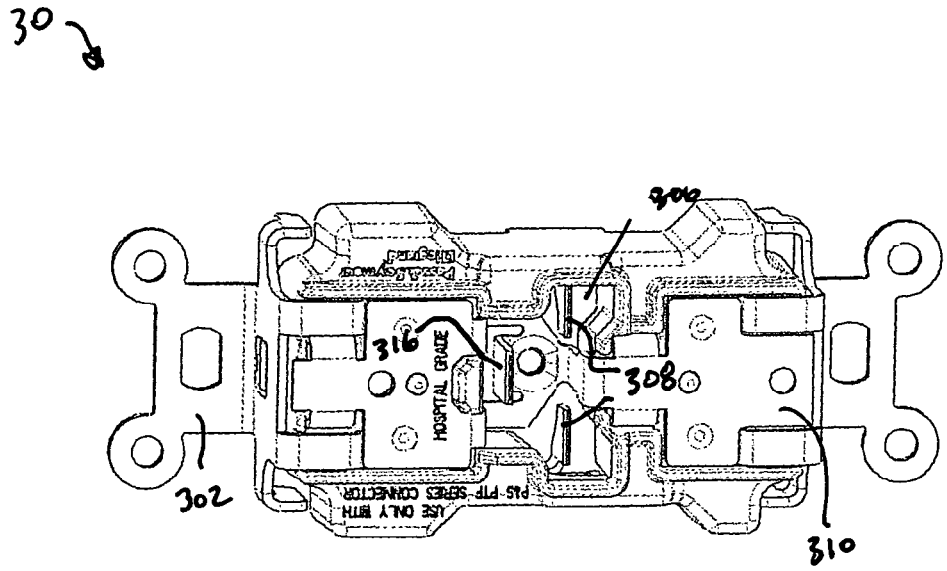
FIG. 3 is a back view of the wiring device depicted in FIG. 1A and FIG. 1, showing a power input receptacle.
Figure 4:
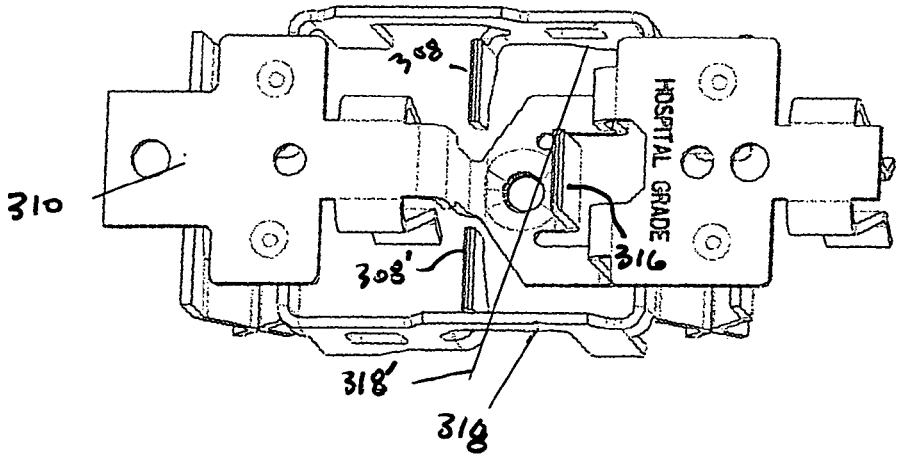
FIG. 4 is a detail view illustrating the construction of the receptacle depicted in FIG. 3.
Figure 5:
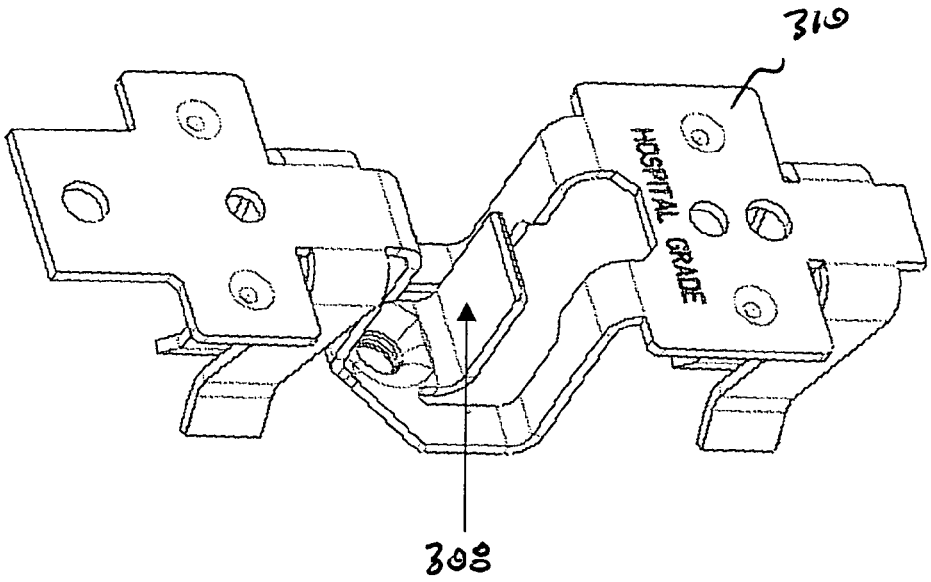
FIG. 5 is a detail view of the wiring device ground chassis in accordance with the present invention.
Figure 6:
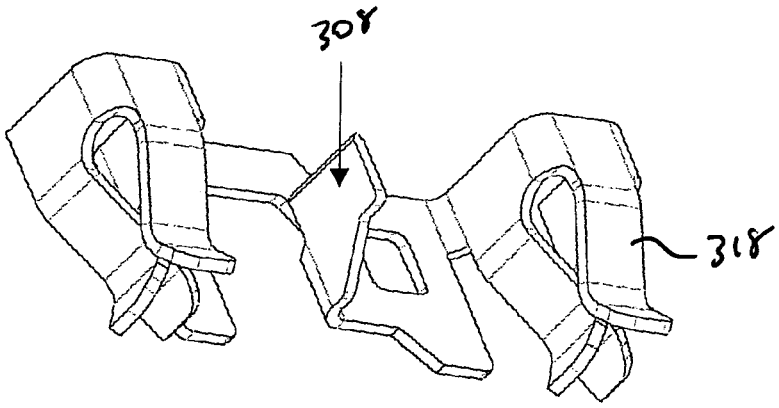
FIG. 6 is a detail view of an electrical contact body employed in the wiring device receptacle in accordance with the present invention.

Referring to FIG. 3, a back view of the wiring device depicted in FIG. 1A and FIG. 1 is disclosed. As shown, receptacle 306 is shaped to accommodate plug connector 20. Receptacle 306 includes male contacts 308 and ground contact 316. Referring to FIG. 4, a detail view illustrating the construction of receptacle 316 is shown. Essentially, the contacts within receptacle 306 are formed by three metallic bodies disposed within molded body 300 (see FIG. 1A). As discussed above, ground chassis 310 includes ground contact 316. Contact body 318 includes contact 308 and supporting structure. Contact body 318' is a mirror image of contact body 318, and includes contact 308'. During fabrication, ground chassis 310 is inserted into a first side of molded body 300, and contact bodies 318, 318' are inserted into the opposing side of body 300, such that contacts 318, 318', and 316 from an integrated set of male contacts suitable for female plug connector 20. FIG. 5 is a detail view showing ground chassis 310 in isolation. FIG. 6 is a detail view of electrical contact body 318 in isolation.

Figure 7:
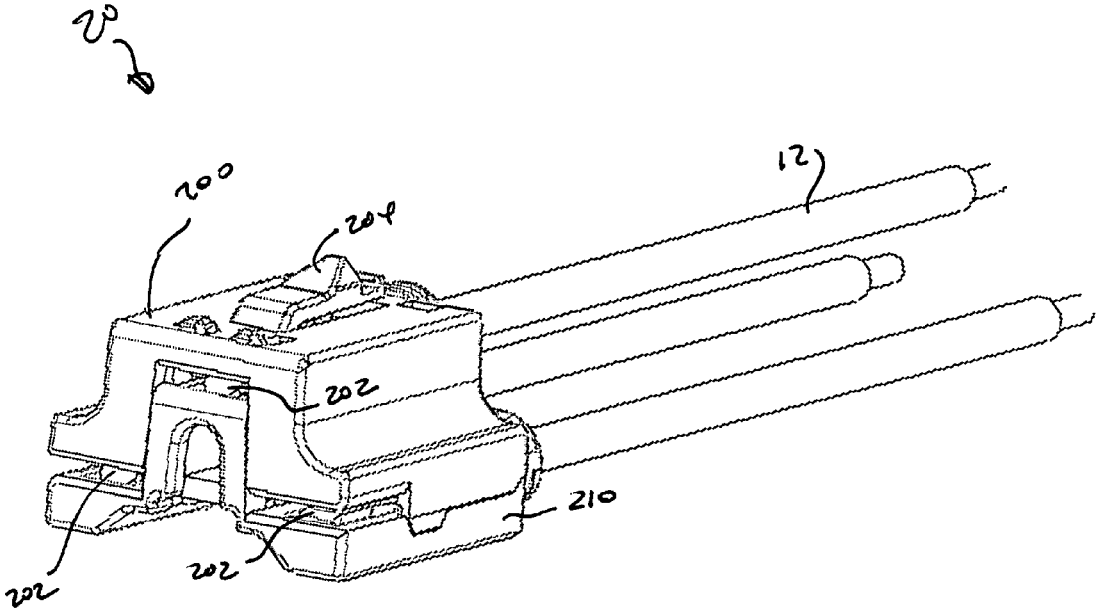
FIG. 7 is a perspective view of the plug connector in accordance with a first embodiment of the present invention.

As embodied herein and depicted in FIG. 7, perspective view of plug connector 20 in accordance with a first embodiment of the present invention is disclosed. Plug connector 20 includes upper housing 200 and lower housing 210. Upper housing 200 is snapped onto lower housing 210 to thereby enclose and terminate wires 12 in plug connector 20. Upper housing 200 includes latch mechanism 204. When plug connector 20 is inserted into receptacle 306, latch mechanism 204 prevents plug 20 from being pulled out of receptacle 306. Latch mechanism 204 is configured to meet Underwriter's Laboratory (UL) standards for a locking connector. In this case, UL requires that a static pull test of 201*b* be applied to the connector for one minute. During the test, plug connector 20 may not separate from receptacle 30.

During operation, latch mechanism 204 flexes upon insertion of plug connector 20. The flexure latch mechanism 204 relaxes to a non-flexed position upon successful locking of plug connector 20 to receptacle 306, and emits an audible snapping sound or visual indication that locking has been achieved. Flexible latch mechanism 204 may also be configured to be accessible to the finger or to a tool when plug connector 20 is locked to receptacle 306. In this embodiment, when latch mechanism 204 is accessed and manually flexed manually, or by the tool, plug connector 20 can be removed from receptacle 306. The flexure is oriented in a direction opposite to the insertion direction in order to meet requirements in Underwriters Laboratories (UL) standards. In another embodiment, plug connector 20 can be locked into receptacle 306 using screws or any number of fastening means familiar to those skilled in the art.

Figure 8:
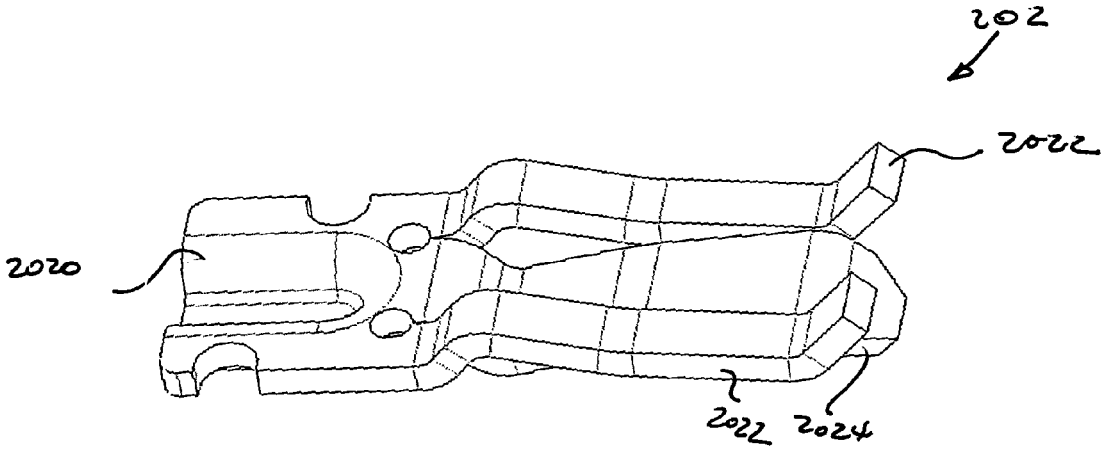
FIG. 8 is a is a detail view of the electrical contacts employed in the plug connector depicted in FIG. 7.

Referring to FIG. 8, a detail view of female electrical contact 202 is depicted. Each contact 202 includes a wire seat portion 2020. Wire seat 2020 accommodates the wire conductor when wire 12 is bonded to contact 202 during termination. Contact 202 also includes two exterior spring contact members 2022, and an interior spring contact member 2024. As those of ordinary skill in the art will appreciate, when male receptacle contacts 308 are inserted, the exterior spring contact members 2022 separate from the interior spring contact member 2024, holding contact 308 firmly therebetween.

Figure 9:
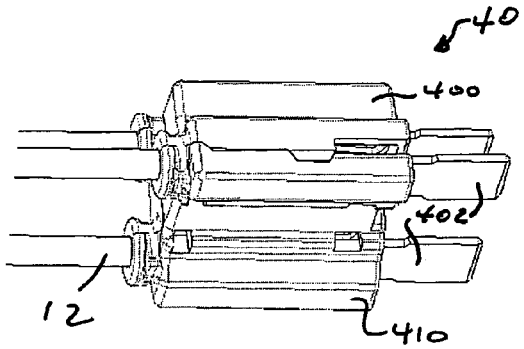
FIG. 9 is a perspective view of the plug connector in accordance with a second embodiment of the present invention.

As embodied herein and depicted in FIG. 9, a perspective view of the plug connector 40 is accordance with a second embodiment of the present invention is disclosed. Plug connector includes upper housing 400 which is mated to lower housing 410. In this embodiment, the female contacts are replaced by male contacts 402. As a result, receptacle 306, disposed in wiring device 30 (not shown), includes female contacts.

Figure 10:
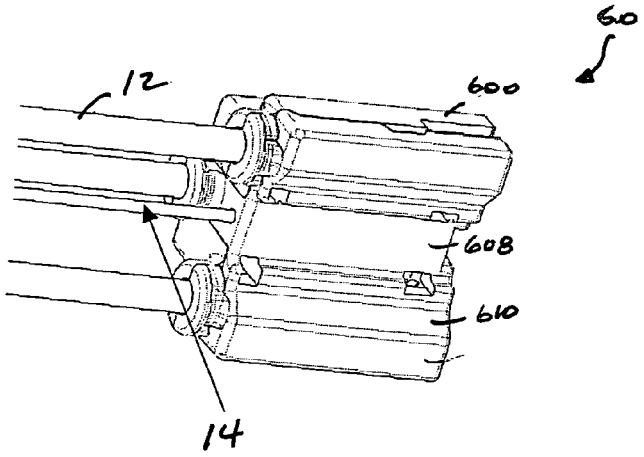
FIG. 10 is a perspective view of the plug connector in accordance with a third embodiment of the present invention.

As embodied herein and depicted in FIG. 10, a perspective view of plug connector 60 is accordance with a third embodiment of the present invention is disclosed. Like the other embodiments, plug connector 60 includes upper housing 600 and lower housing 610. However, this embodiment includes an additional contact that accommodates communications wire 14. Communications wire 14 transmits wiring device 30 status data, such as a detected fault condition, to a receiver disposed in the structure. Obviously, connector 60 mates to a wiring device 30 that includes a sensor and a transmitter. With respect to the transmitter employed by device 30, any suitable system may be employed, including optical, acoustic, or RF transmitters. For example, wiring device 30 may include an RF tag that transmits a fault detect code in the presence of a fault condition.

Figure 11:
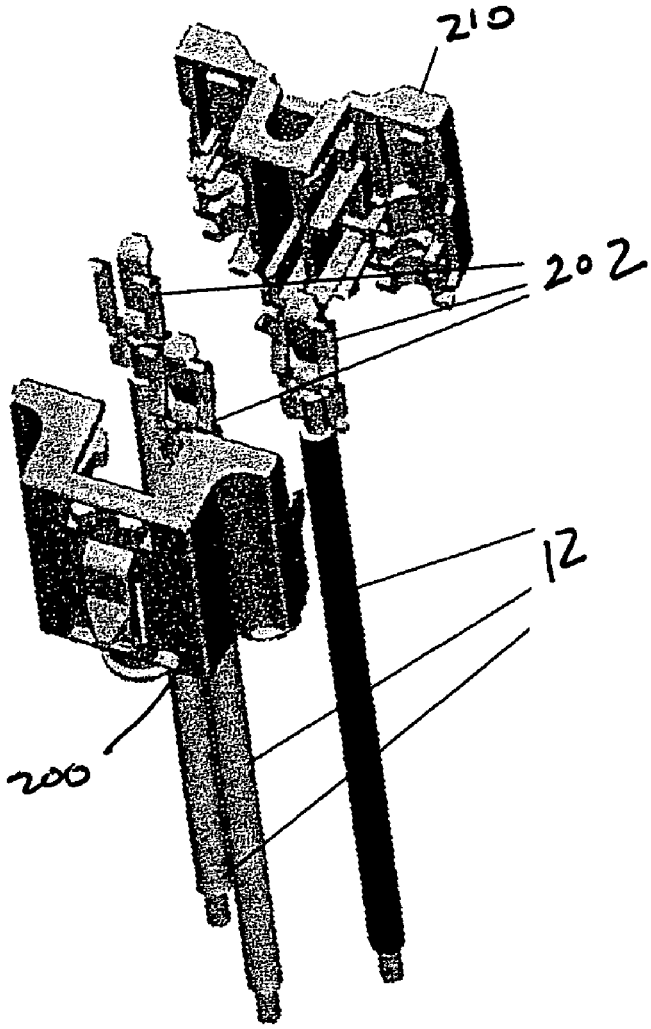
FIG. 11 is an exploded view of the plug connector depicted in FIG. 7, illustrating a first method for terminating the plug connector.

Referring to FIG. 11, an exploded view of the plug connector depicted in FIG. 7. FIG. 11 illustrates a first method for terminating plug connector 20 to wire 12. After each wire 12 is stripped, it is placed in seat 2020 (See FIG. 8), and bonded to the contact. Each contact 202 is disposed in upper housing 200. Subsequently, lower housing 210 is snapped into place to thereby secure contacts 202. In an alternate embodiment, contacts 202 are disposed in either upper housing 200 or in lower housing 210. Each contact 202 includes a blade elements. The blade elements is configured to displace insulation disposed on wire 12 when lower housing 210 is snapped onto upper housing 200. The blade element contacts the conductor after the insulation is displaced, such that electrical continuity is established between wire 12 and contact 202.

Figure 12:
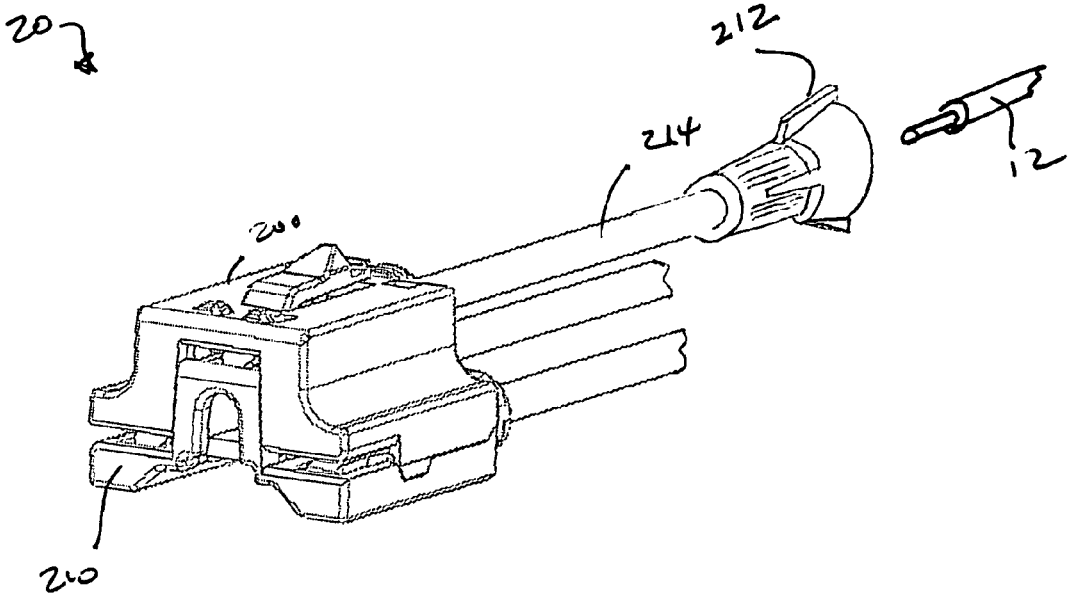
FIG. 12 is a perspective view of the plug connector depicted in FIG. 7, illustrating a second method for terminating the plug connector.

Referring to FIG. 12, a perspective view of plug connector 20 is shown, illustrating a second method for terminating wires 12 to plug connector 20. In this embodiment, plug 20 is equipped with leads 214 which are terminated to contacts 202 at the factory. During wire 12 termination, twist-on wire connector 212 is essentially screwed onto stripped wire 12.

Figure 13:
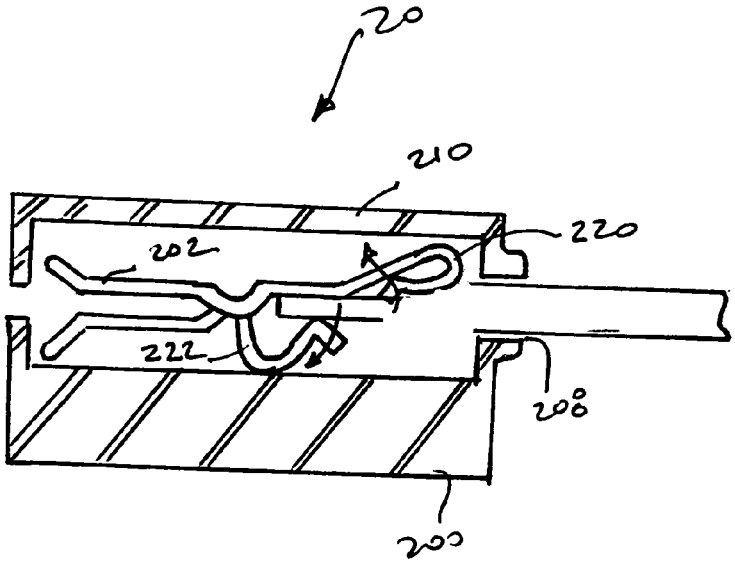
FIG. 13 is a perspective view of the plug connector depicted in FIG. 7, illustrating a third method for terminating the plug connector.

Referring to FIG. 13, a perspective view of plug connector 20 is shown, illustrating a third method for terminating wires 12 to plug connector 20. In this embodiment, each contact 202 in plug 20 is equipped with spring 220 and spring 222, which are configured to press one against the other before wire installation. When wire 12 is inserted into opening 208, spring 220 separates from spring 222. Spring 222 actuates trigger mechanism 224 which includes a metallic saw-tooth mechanism 206. Mechanism 206 bites into wire 12, securing it in place.

As those of ordinary skill in the art will recognize, the present invention is ideally suited for installing electrical wiring in any structure. During any installation, after the wires are placed between the breaker location to the location wherein the electrical device 30 is to be installed, wires 12 may be terminated to plug connector 20 using any of the methods described above. Subsequently, plug connector 20 is inserted into receptacle 306 of wiring device 30, to thereby establish electrical continuity between the electrical wiring device and the plurality of wires.

Figure 14:
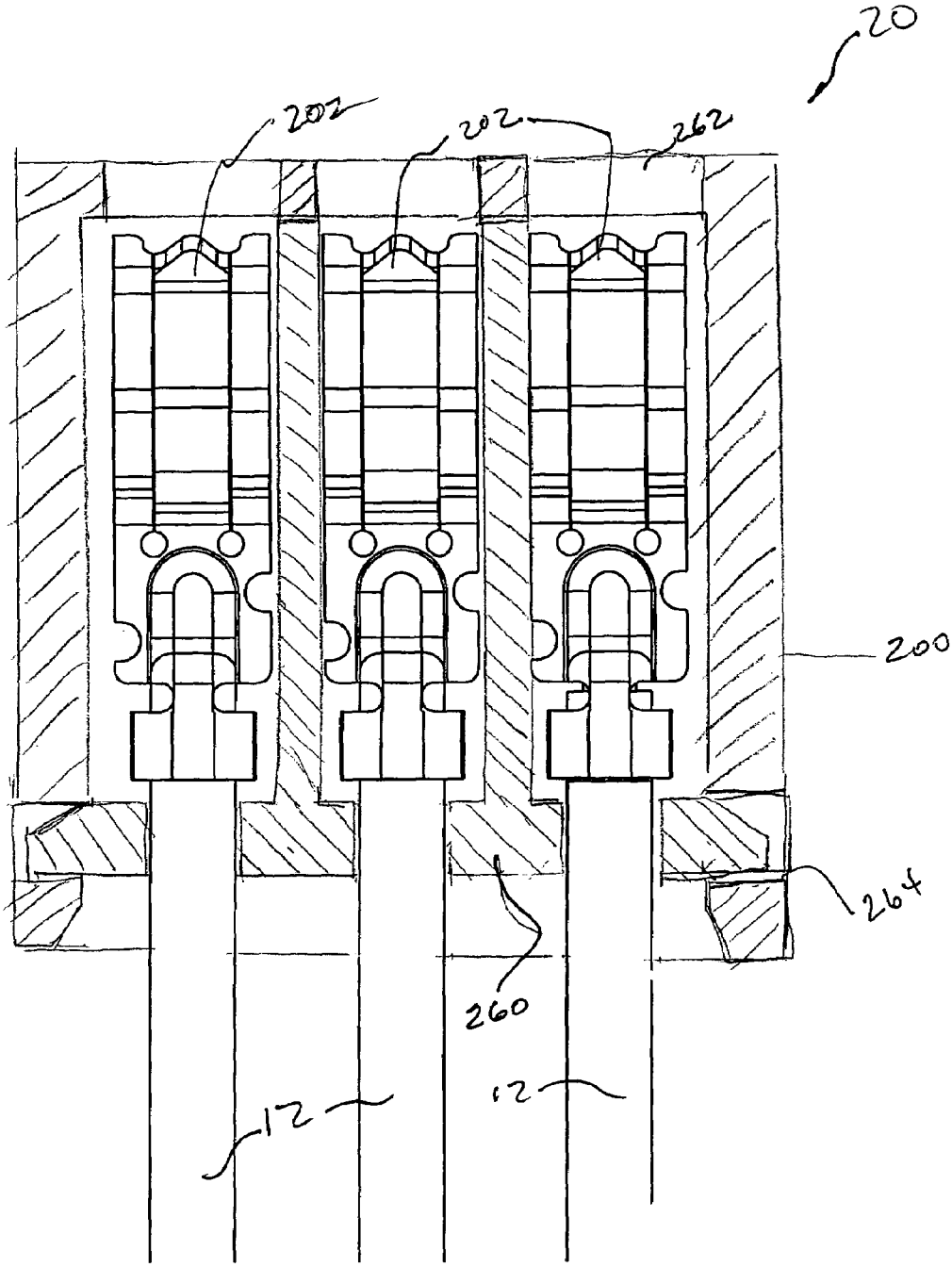
FIG. 14 is a cross-sectional view of the plug connector in accordance with an alternate embodiment of the present invention.

Referring to FIG. 14, a cross-sectional view of the plug connector 20 in accordance with an alternate embodiment of the present invention is disclosed. In this embodiment, plug connector 20 is arranged with plug contacts 202 adjacent one to the other within housing 200. Thus, contact openings 262 are likewise adjacent one to the other. Contact support member 260 is inserted into opening 264 of housing 200, to support contacts 202, which are terminated on wires 12.

Figure 15:
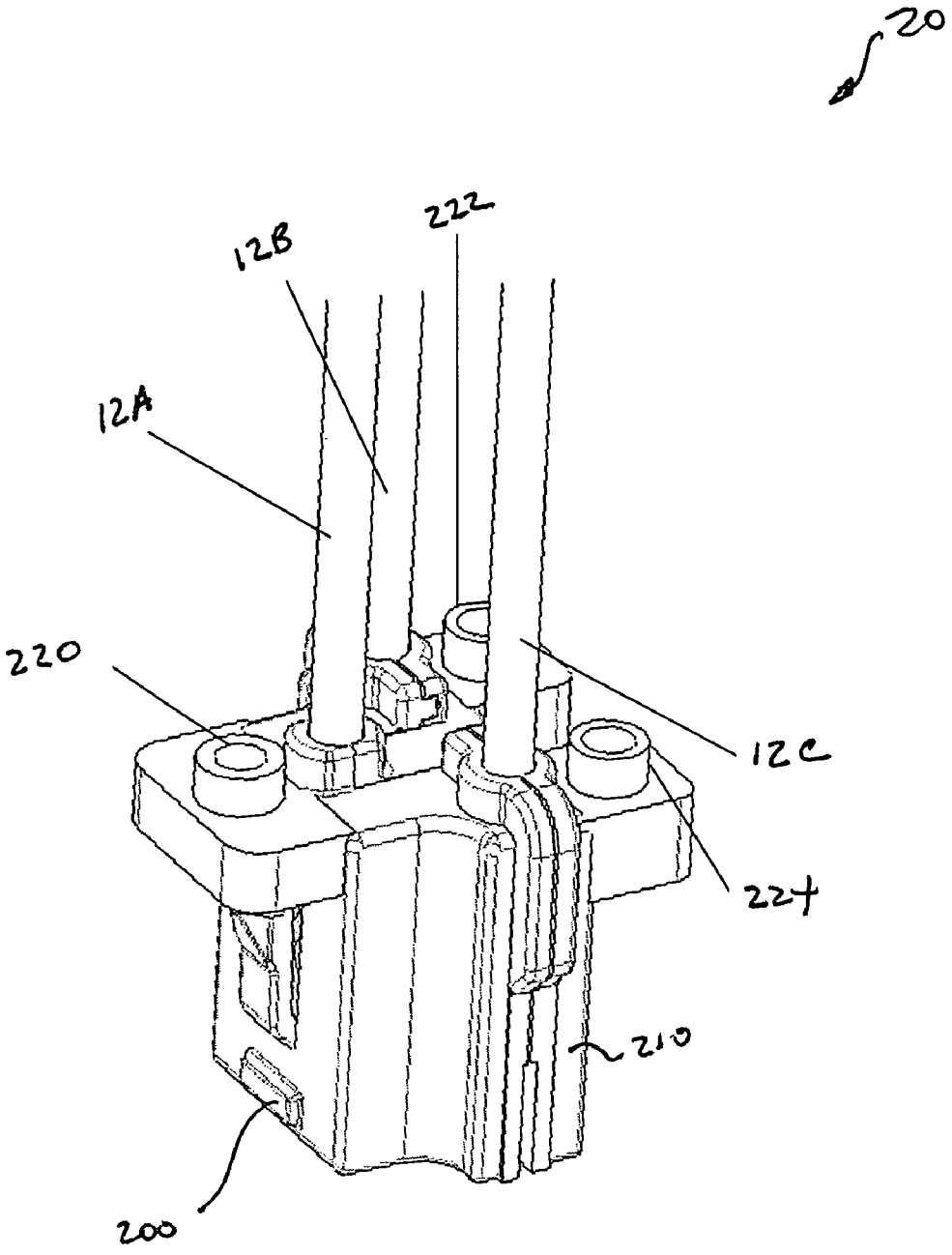
FIG. 15 is a perspective view of a feed-through plug connector in accordance with an embodiment of the invention.

Referring to FIG. 15, a perspective view of a feed-through plug connector in accordance with an embodiment of the invention. As those of ordinary skill in the art will understand, often receptacles are daisy chained by way of feed through wires. In this embodiment, there is electrical connectivity between wire 12A and wire terminal 226, wire 2B and wire terminal 228, and wire 12C and wire terminal 230. Those of ordinary skill in the art will recognize that a feed through wire may be connected to terminal 226, 228, or 230 by any suitable means. For example, the feed-through wire may be connected to the wire terminal in a pre-assembled manner, such as that shown in FIG. 7. Terminals 226, 228, and 230 may be configured as twist-on wire connector terminals, as show in FIG. 12. Further, the method described in FIG. 13 may also be used to terminate feed-through wires to terminals 226, 228, and 230. Terminals 226, 228 and 230 can be included in connector plug 20. Alternatively, terminals 226, 228 and 230 can be in a second connector plug 20' that attaches to a receptacle 306' electrically coupled to wires 12A, 12B and 12C (not shown). Wires 12A, 12B, and 12C may couple electricity to wiring device 30 either through connector plug 20 or some alternate means such as screw terminals. In addition, connector plugs 20 and 20' may be configured so as to not be interchangeable.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. An electrical wiring system comprising:

a plug connector device configured to terminate a plurality of wires, the plurality of wires being configured to transmit electrical power provided by an electrical power distribution system; and an electrical wiring device configured to provide the electrical power to a load, the electrical wiring device being substantially disposed between a user accessible cover member and a body member, the electrical wiring device including a receptacle disposed in the body member, the receptacle being configured to receive the plug device, whereby electrical continuity is established between the electrical wiring device and the plurality of wires when the plug device is inserted into the receptacle.

2. The system of claim 1, wherein the plug device includes female electrical contacts and the receptacle includes male electrical contacts.

3. The system of claim 1, wherein the plug device includes male electrical contacts an the receptacle includes female electrical contacts.

4. The system of claim 1, wherein the plurality of wires includes an AC power conductor and a neutral conductor.

5. The system of claim 1, wherein the plurality of wires are configured to carry three-phase power.

6. The system of claim 1, wherein the plurality of wires includes a ground wire.

7. The system of claim 1, wherein the electrical wiring device includes an electrical receptacle configured to accept a power plug coupled to an electrical load.

8. The system of claim 1, wherein the electrical wiring device includes an electrical switch.

9. The system of claim 1, wherein the electrical wiring device includes a GFCI device.

10. The system of claim 1, wherein the electrical wiring device includes a lighting fixture.

11. The system of claim 1, wherein the electrical wiring device includes a sensor device.

12. The system of claim 1, wherein the electrical wiring device includes a transient voltage surge suppressor.

13. The system of claim 1, wherein the electrical wiring device includes an environmental regulation device.

14. The system of claim 1, wherein the electrical wiring device includes a timer device.

15. The system of claim 1, wherein the plug device includes a plurality of self-locking contacts, each self-locking contact accommodating one of the plurality of wires, such that electrical continuity is established between each wire and each plug contact, and wherein each plug contact corresponds to a contact disposed in the receptacle.

16. The system of claim 1, wherein the plug device includes a plurality of threaded twist-on wire connectors, each threaded twist-on wire connector being coupled to a plug contact and configured to accommodate one of the plurality of wires, such that electrical continuity is established between each wire an each plug contact, and wherein each plug contact corresponds to a contact disposed in the receptacle.

17. The system of claim 1, wherein the plug device further comprises:

a first housing portion;

a second housing portion configured to mate with the first housing portion to thereby form the plug device housing; and a plurality of contacts including blade elements, the plurality of contacts being disposed in either the first plug connector housing or the second plug connector housing or both, the blade elements being configured to displace insulation disposed on the plurality of wires when the second plug connector housing is coupled to the first plug connector housing, whereby electrical continuity is established between each wire and a corresponding one of the plurality of contacts.

18. The system of claim 1, wherein the electrical wiring device includes a communications device configured to transmit a system status.

19. The system of claim 18, wherein the communications device is configured to transmit the system status via a communications wire, the plug connector being configured to accommodate the communications wire.

20. The system of claim 18, wherein the communications device is configured to transmit the system status optically.

21. The system of claim 18, wherein the communications device is configured to transmit the system status acoustically.

22. The system of claim 18, wherein the communications device is configured to transmit the system status by way of an electromagnetic transmission.

23. The system of claim 22, wherein the electromagnetic transmission includes an RF signal.

24. The system of claim 1, further including a second plurality of wires configured to transmit electric power to a feed-through device, wherein the plug device is configured to terminate the second plurality of wires to thereby electrically couple the electric power source to the second plurality of wires.

25. The system of claim 24, wherein the electrical wiring device includes an electrical receptacle configured to accept a power plug coupled to an electrical load.

26. The system of claim 24, further comprising a second plug connector device configured to terminate the second plurality of wires, the second plurality of wires being configured to transmit electrical power provided by an electrical power distribution system to the feed-through device.

27. The system of claim 26, wherein the electrical wiring device includes an electrical receptacle configured to accept a power plug coupled to an electrical load.

28. The system of claim 1, further comprising a latching mechanism configured to prevent the plug connector device from being removed from the receptacle to thereby ensure that electrical continuity is maintained between the electrical wiring device and the plurality of wires.

29. The system of claim 28, wherein the latching mechanism is manually moveable to permit removal of the plug connector device from the receptacle.

30. The system of claim 28, wherein the latching mechanism provides an indication that the plug connector is locked in the inserted position.

31. The system of claim 28, wherein the indication is an audible indication.

32. The system of claim 28, wherein the indication is an visual indication.

33. A method for installing electrical wiring, the method comprising:

installing a plurality of wires from a first location to an electrical device location, at least a portion of the plurality of wires being configure to transmit electrical power;

terminating the plurality or wires with a plug connector;

providing an electrical wiring device configured to provide electrical power to a load, the electrical wiring device being substantially disposed between a user accessible cover member and a body member, the electrical wiring device including a receptacle disposed in the body member, the receptacle being configured to receive the plug device; and inserting the plug connector into the receptacle, whereby electrical continuity is established between the electrical wiring device and the plurality of wires.

34. The method of claim 33, and wherein the step of terminating includes the step of inserting each of the plurality or wires into a self-locking contact element within the plug connector, such that there is electrical continuity between each wire and each plug contact.

35. The method of claim 33, wherein the step of terminating further comprises the steps of:

inserting each wire into a corresponding one of a plurality of threaded twist-on wire connectors coupled to the plug connector, each threaded twist-on wire connector being coupled to a plug contact and configured to accommodate one of the plurality of wires, and twisting each twist-on wire connector such that the wire is secure within the twist-on wire connector and electrical continuity is established between each wire and each plug contact.

36. The method of claim 33, and wherein the step of terminating further comprises:

inserting the plurality of wires into a first plug connector housing; and coupling a second plug connector housing to the first plug connector housing to thereby terminate the plurality of wires in the plug connector, either the first plug connector housing or the second plug connector housing, or both, including contacts having blade elements, the blade element being configured to displace insulation disposed on the plurality of wires when the second plug connector housing is coupled to the first plug connector housing, whereby electrical continuity is established between each wire and a corresponding contact.

37. The method of claim 33, wherein the plug device includes female electrical contacts and the receptacle includes male electrical contacts.

38. The method of claim 33, wherein the plug device includes male electrical contacts and the receptacle includes female electrical contacts.

39. The method of claim 33, wherein the steps of installing further comprises:

disposing conduit between the first location and the second location; and pulling the plurality of wires through the conduit.

40. A method for installing an electrical wiring device, comprising the steps of:

a. providing a connector device that is adapted to be operably received by the electrical wiring device and that includes a first plurality of electrical contacts disposed therein;

b. terminating the connector device to a plurality of wires, the plurality of wires being in electrical communication with said first plurality of electrical contacts;

c. providing an electrical wiring device substantially disposed between a user accessible cover member and a body member having a predetermined area in which a second plurality of electrical contacts are disposed, the electrical wiring device including at least one element configured to provide electrical power to a load; and d. placing said connector device into electrical communication with the electrical device, wherein said first plurality of electrical contacts are in contacting relation with corresponding ones of said second plurality of electrical contacts.

41. The electrical wiring system according to claim 40, wherein said first plurality of electrical contacts comprises blades.

42. The method for interconnecting a plurality of wires according to claim 40, wherein said predetermined area is a receptacle adapted to receive said first plurality of contacts therein.

43. The electrical wiring system according to claim 42, wherein said second plurality of electrical contacts comprise female receptacles.

44. The electrical wiring system according to claim 40, wherein said second plurality of electrical contacts comprise female receptacles.

45. The electrical wiring system according to claim 44, wherein said first plurality of electrical contacts comprises blades.

46. An electrical wiring system comprising:

a an electrical wiring device substantially disposed between a user accessible cover member and a body member having a predefined area in which a first plurality of electrical contacts are positioned, the electrical wiring device including at least one element configured to provide electrical power to a load;

b. a connector device configured to be positioned in contacting relation with the electrical wiring device, the connector device including a plurality of termination elements configured to terminate a plurality of wires; and c. a second plurality of electrical contacts disposed in said connector device and electrically coupled to said plurality of termination elements, the second plurality of electrical contacts being configured to be placed in electrical contact with said first plurality of electrical contacts when said connector device is positioned in contacting relation with said electrical wiring device.

47. The electrical wiring system according to claim 46, wherein said second plurality of electrical contacts comprises blades.

48. The electrical wiring system according to claim 46, wherein said predefined area is a receptacle adapted to receive said second plurality of contacts therein.

49. The electrical wiring system according to claim 48, wherein said first plurality of electrical contacts comprise female receptacles.

50. The electrical wiring system according to claim 46, wherein said first plurality of electrical contacts comprise female receptacles.

51. The electrical wiring system according to claim 50, wherein said second plurality of electrical contacts comprises blades.

* * * * *

US006994585C1

(12) INTER PARTES REEXAMINATION CERTIFICATE (646th)

United States Patent
Benoit et al.

(10) Number: US 6,994,585 C1
(45) Certificate Issued: Jul. 23, 2013

(54) ELECTRICAL WIRING SYSTEM

(75) Inventors: John Benoit, Montpelier, VT (US); Gerald R. Savicki, Jr., Syracuse, NY (US)

(73) Assignee: Pass & Seymour, Inc., Syracuse, NY (US)

Reexamination Request:
No. 95/000,200, Nov. 29, 2006

Reexamination Certificate for:

| | |
|---|---|
| Patent No.: | **6,994,585** |
| Issued: | **Feb. 7, 2006** |
| Appl. No.: | **10/680,797** |
| Filed: | **Oct. 7, 2003** |

(51) Int. Cl.
*H01R 13/60* (2006.01)
*H01R 25/00* (2006.01)

(52) U.S. Cl.
CPC ..... *H01R 25/003* (2013.01)
USPC ..... 439/535; 439/536; 174/58

(58) Field of Classification Search
None
See application file for complete search history.

(56) References Cited

To view the complete listing of prior art documents cited during the proceeding for Reexamination Control Number 95/000,200, please refer to the USPTO's public Patent Application Information Retrieval (PAIR) system under the Display References tab.

*Primary Examiner* — Albert J Gagliardi

(57) ABSTRACT

The present invention is directed to an electrical wiring system. The system includes a plug connector device that is configured to terminate a plurality of wires. A portion of the plurality of wires are configured to transmit electrical power provided by an electrical power distribution system. An electrical wiring device is configured to provide the electrical power to a load. The electrical wiring device includes a receptacle disposed therein. The receptacle is configured to receive the plug device, such that electrical continuity is established between the electrical wiring device and the plurality of wires when the plug device is inserted into the receptacle.

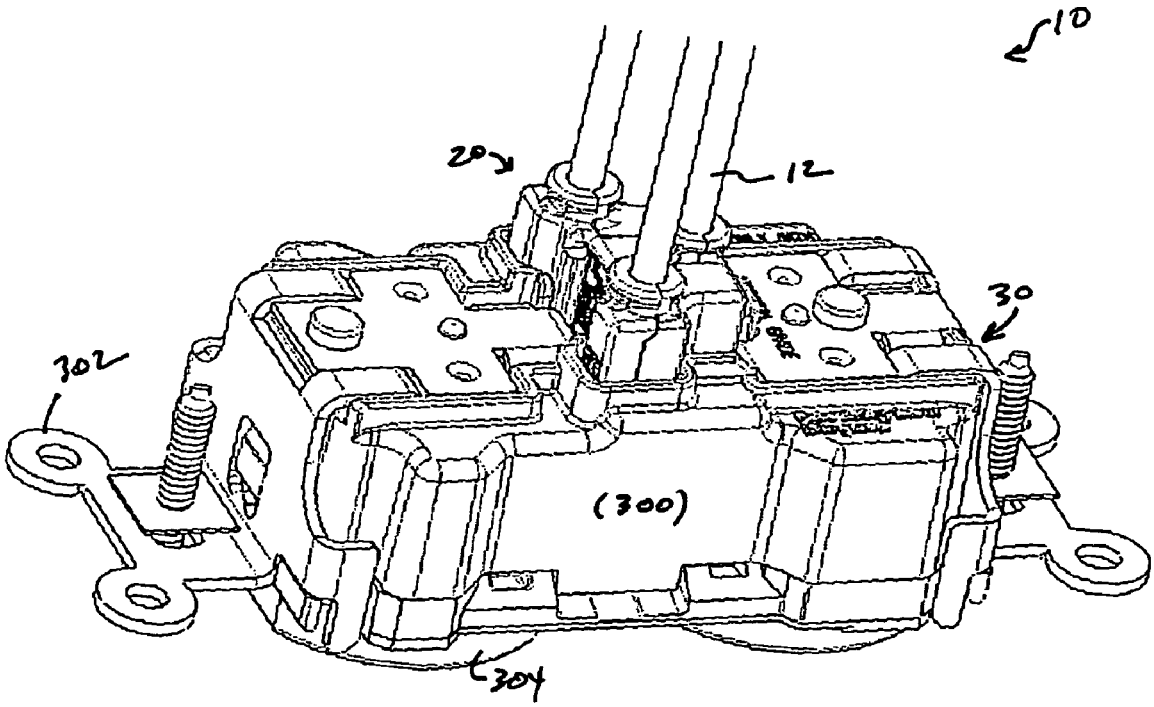

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-51 are cancelled.

* * * * *